US012673794B2

(12) United States Patent
Slavinski et al.

(10) Patent No.: US 12,673,794 B2
(45) Date of Patent: Jul. 7, 2026

(54) ADAPTABLE SPACER ROPING INSTALLATION METHOD FOR CASTED CONCRETE PRODUCTS OR THE LIKES

(71) Applicant: Besser Robotics Inc., Saint-Hubert (CA)

(72) Inventors: Benoit Slavinski, St-Basile-Le-Grand (CA); Ludovic Legendre, Montreal (CA); Victor Harvey-Rhéaume, Saint-Jean-sur-Richelieu (CA)

(73) Assignee: Besser Robotics Inc., Saint-Hubert (CA)

( * ) Notice: Subject to any disclaimer, the term of this patent is extended or adjusted under 35 U.S.C. 154(b) by 0 days.

(21) Appl. No.: 19/192,724

(22) Filed: Apr. 29, 2025

(65) Prior Publication Data

US 2025/0256874 A1 Aug. 14, 2025

Related U.S. Application Data

(62) Division of application No. 18/328,291, filed on Jun. 2, 2023, now Pat. No. 12,312,109.

(51) Int. Cl.

| | |
|---|---|
| ***B65B 11/02*** | (2006.01) |
| ***B65B 35/18*** | (2006.01) |
| ***B65B 61/00*** | (2006.01) |

(52) U.S. Cl.

CPC ..... *B65B 11/02* (2013.01); *B65B 35/18* (2013.01); *B65B 61/005* (2013.01); *B65B 2210/20* (2013.01)

(58) Field of Classification Search

CPC ..... B65B 11/02; B65B 35/18; B65B 61/005; B65B 2210/20

See application file for complete search history.

(56) References Cited

U.S. PATENT DOCUMENTS 3,135,192 A * 6/1964 Derrickson ..... B65B 13/08 100/8
3,152,539 A * 10/1964 Sorensen ..... B65B 13/186 100/8
3,379,121 A * 4/1968 Lems ..... B65B 27/06 53/589
3,566,780 A * 3/1971 Chisek ..... B65B 27/04 100/14

(Continued)

*Primary Examiner* — Lucas E. A. Palmer

(74) *Attorney, Agent, or Firm* — Agence de Brevets Fournier

(57) ABSTRACT

An adaptable spacer robot installation method includes providing a robot for positioning adjacent a palletizing surface, and a rope-positioning bar for positioning adjacent the palletizing surface. The robot is equipped with a tool head that allows receiving and dispensing a plurality of ropes from different dispensing positions along the tool head. The rope-positioning bar includes at least a same number of grippers than the number of dispensing positions along the tool head. The grippers are so positioned along the rope-positioning bar to allow grippers thereon gripping in unison the plurality of ropes dispensed by the tool head. The robot is moved from a first position, wherein the tool head is so positioned relative to the rope-positioning bar that each of the dispensing positions is registered and adjacent one of the grippers, to a second position, wherein the tool head is positioned distanced from the rope-positioning bar, parallel thereto, above the palletizing surface.

9 Claims, 13 Drawing Sheets

(56) References Cited

U.S. PATENT DOCUMENTS 3,899,963 A * 8/1975 Tremper ..... B65B 13/06 100/25
4,058,270 A * 11/1977 Simmons ..... B21C 47/18 242/561
4,866,909 A * 9/1989 Lancaster, III ..... B65B 11/008 53/399
5,088,270 A * 2/1992 Diehl ..... B65B 11/025 53/399
5,107,657 A * 4/1992 Diehl ..... B65B 11/025 53/389.2
5,400,706 A * 3/1995 Tipton ..... B65B 13/06 53/589
7,908,831 B1 * 3/2011 Dugan ..... B65B 11/006 53/389.2
9,944,417 B2 * 4/2018 Lemieux ..... B65B 11/045
12,214,915 B2 * 2/2025 Schulz ..... B65B 13/06
2002/0029540 A1 * 3/2002 Lancaster, III ..... B65B 11/008 53/399
2003/0093974 A1 * 5/2003 Rossi ..... B65B 11/045 53/399
2005/0044812 A1 * 3/2005 Lancaster, III ..... B65B 41/16 53/399
2006/0260279 A1 * 11/2006 Jafari ..... B65B 11/585 53/399
2008/0258123 A1 * 10/2008 Xue ..... B30B 9/3071 254/252
2012/0247347 A1 * 10/2012 Harris ..... B65B 13/06 100/3
2014/0033657 A1 * 2/2014 Cere' ..... B65B 11/00 53/461
2014/0331609 A1 * 11/2014 Bison ..... B65B 11/585 53/219
2015/0101281 A1 * 4/2015 Kudia ..... B65B 57/18 53/51
2015/0197360 A1 * 7/2015 Lancaster, III ..... B65B 57/04 53/461
2015/0272009 A1 * 10/2015 Adams ..... A01F 15/0825 100/17
2017/0174450 A1 * 6/2017 Zi ..... B25J 9/0078
2018/0162567 A1 * 6/2018 Ceré ..... B65B 21/245
2019/0241293 A1 * 8/2019 Adams ..... B30B 9/3025
2019/0291901 A1 * 9/2019 Stone ..... B65B 13/04
2020/0165018 A1 * 5/2020 Cere' ..... B65B 11/025
2021/0086927 A1 * 3/2021 Lancaster, III ..... B65B 11/045
2021/0107692 A1 * 4/2021 Lopes ..... B65B 11/585
2021/0269207 A1 * 9/2021 Sparschuh ..... B65B 69/0025
2021/0269229 A1 * 9/2021 Sparschuh ..... B65B 13/02
2022/0002012 A1 * 1/2022 Lancaster, III ..... B65B 11/025
2022/0274752 A1 * 9/2022 Zimmer ..... B65D 71/0096
2023/0059103 A1 * 2/2023 Jackson ..... B65G 57/03
2023/0391481 A1 * 12/2023 Bell ..... B65B 57/16
2024/0140634 A1 * 5/2024 Salisbury ..... B65B 11/045
2024/0359840 A1 * 10/2024 Goodrich ..... B31D 3/04
2024/0400244 A1 * 12/2024 Slavinski ..... B65B 35/18

* cited by examiner

ADAPTABLE SPACER ROPING INSTALLATION METHOD FOR CASTED CONCRETE PRODUCTS OR THE LIKES

CROSS REFERENCE TO RELATED PATENT APPLICATION

This application is a division of U.S. patent application Ser. No. 18/328,291, filed on Jun. 2, 2023, titled "Adaptable Spacer Roping Installation System for Casted Concrete Products or the Likes and Palletizing System Therewith", currently pending, the content of which is incorporated by reference herein.

FIELD

The present disclosure concerns the palletization of casted concrete products. More specifically, the present disclosure is concerned with an adaptable spacer robot installation system therefor.

BACKGROUND

Spacer robot systems are known that allows inserting portions of ropes between products during their palletizing, aiming at preventing damages to the products due to shock or impact therebetween during transport.

While such systems are effective, they are specifically designed to work with products having a predetermined geometry and are integrated to a palletizing system. As such, they are not adaptable for a variety of products and for different palletizing systems.

SUMMARY

According to an illustrative embodiment, there is provided a method for palletizing a plurality of products, the method comprising:

- providing a palletizing surface;
- providing a rope distribution system;
- providing a first robot arm equipped with a robot tool including rope nozzles;
- threading ropes from the rope distribution system through the robot tool, so that each of the ropes freely passing through a respective one of the rope nozzles;
- moving the robot tool to a first position that is in close proximity to the palletizing surface near a first side thereof;
- gripping the ropes at the first position;
- moving the robot tool to a second position that is both a) near a second side of the palletizing surface that is opposite the first side thereof and b) sufficiently high above the palletizing surface to yield clearance to move the products to be palletized thereon, yielding lengths of the ropes between the first position and the robot tool;
- using a second robot to pick one of the products at a product-delivering location and moving said one of the products on the palletizing surface and on the lengths of ropes;
- releasing the ropes at the first position;
- until all of the products have been palletized into a stack of products, repeatedly moving the robot tool between the first and second positions and moving another one of the products on the palletizing surface between each movement of the robot tool; and
- cutting the ropes.

The expression "robot arm" is to be construed broadly in the description and in the claims to include any programmable or controllable system or mechanism robot consisting of parts linked together to move a tool or head within a three-dimensional space. The tool or head can be integrated to the arm or removably mountable thereto.

Similarly, the expression robot tool or head will be used herein interchangeably and should be construed as any mechanism or sub-system configured to perform one or more tasks.

The term "rope" should be construed in the description and in the claims as including any types of cord or the like, made of any material and being of any caliber and being suitable to be used as spacer between products.

Other objects, advantages and features of embodiments of an adaptable spacer robot installation system for casted concrete products or the likes and palletizing system therewith will become more apparent upon reading the following non-restrictive description of preferred embodiments thereof, given by way of example only with reference to the accompanying drawings.

DETAILED DESCRIPTION

Figure 1:
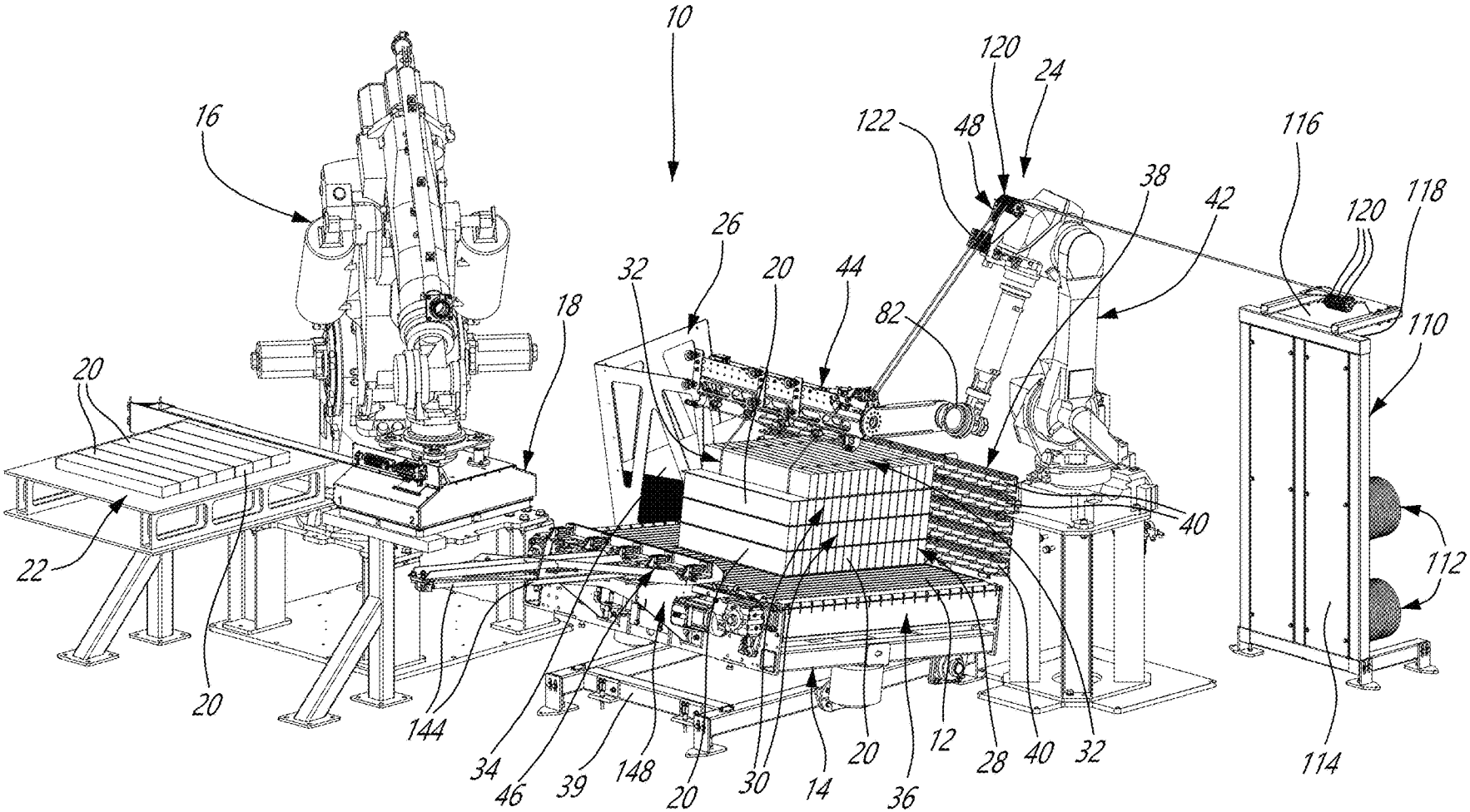
FIG. 1 is a perspective view of a palletizing system according to a first illustrative embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

A palletizing system 10 according to a first illustrative embodiment will first be described with reference to FIG. 1.

The palletizing system 10 comprises a palletizing surface 12, defined by a conveying system 14, a first robot 16, equipped with a vacuum gripper 18 for gripping one of the products 20 on a product-delivering surface 22 and for moving the product 20 on the palletizing surface 12, an adaptable spacer robot system 24 according to a first illustrative embodiment, and a slip-sheet dispenser 26.

The palletizing system 10 uses as input individual products, in the form of rectangular concrete blocks 20, and outputs an orderly stack 28 of blocks 20, including a plurality of layers 30, each separated by two parallel lengths of ropes 32.

As will be described hereinbelow in more detail, the adaptable spacer robot system 24 allows inserting spacer rope portions between layers 30 of products 20. The system 24 is said to be adjustable as no changes are required to its components to add more or less rope portions 32 than two (2) between layers 30 and can also be adapted to different products. Moreover, the system 24 according to the first illustrative embodiment, can be used, without further modification to insert a slip-sheet 34 under and/or over a stack 28 of a certain number of products 20.

The conveying system 14 includes a conveyor 36 and a frictionless wall 38.

The palletizing surface 12 is defined by the top surface of the conveyor 36, which can further be operated to move the stack 28 of products 20 once it is finished assembled. While it is not shown in FIG. 1, a pallet can further be provided on the conveyor 15 to define the palletizing surface 12.

The conveyor 36 is slanted towards the wall 38, which acts as a mechanical stop when piling the products 20 on the conveyor 36. For that purpose, the conveyor 36 is mounted to a tilting lift 39.

The frictionless wall 38 is in the form of superimposed roller tracks 40 (five (5) according to the illustrated embodiment) which are assembled to or mounted behind the conveyor 36. The wall 38 defines an angle of 95 degrees with the palletizing surface 12. According to another illustrative embodiment, the wall 38 defines another angle, such as an angle within the range of about 90 to 95 degrees, According to another illustrative embodiment, the frictionless wall 38 is replaced by another type of mechanical stop (not shown). According to still another illustrative embodiment, the palletizing surface 12 is not slanted and/or the wall 36 is omitted.

While a single conveying system 14 is illustrated in FIG. 1, one or more additional conveying system may be provided adjacent the conveying system 14 to move the assembled stack 28 away from the palletizing surface 12.

According to still another illustrative embodiment (not shown), other mechanism or device can be provided to remove the assembled stack 28, such as a forklift (not shown).

The conveyor 36 can be any type of conveyor, including without limitations a belt conveyor, a chain conveyor, etc.

According to another embodiment (not shown), the conveyor 14 is replaced by an output table or any other means adapted to receive the products 20.

Since conveying systems are believed to be well known in the art, they will not be described herein in more detail for concision purposes.

The product-delivering surface 22, which is simplified in FIG. 1 as being simply a table, can be part of a conveying system (not shown). Also, while the products 20 are shown in FIG. 1 as being laid directly onto the table 20, the products 20 may be brought to the product delivering surface 22 on a pallet (not shown). In such a case, a pallet-discarding system (not shown) may further be operatively provided near the delivering surface 22. Since product-delivering surface and system are believed to be well-known in the art, they will not be described herein in more detail for concision purposes.

The robot 16 is in the form of conventional robot arms, such as, without limitation, a Fanuc™ robot from the F-400, N-710, N-900 or R-2000 series. The arm 16 is equipped with a vacuum gripper 18.

The vacuum gripper 18 is configured for selectively picking and releasing one product 20 at a time. For example, the vacuum gripper 18 can be a universal foam type gripper or a suction cup-type gripper.

According to another embodiment (not shown), the vacuum gripper 18 is replaced by a clamping or squeezing device or by another type of gripper.

Since the operations of a robot and of a vacuum gripper are believed to be well known in the art, they will not be described herein in more detail for concision purposes.

The robot arm 16 is positioned within reach of both the delivering and palletizing surfaces 12 and 22, for moving products 20 therebetween.

The robot arm 16 is automatically operated with information related to the geometry and dimensions of the product 20 and positions and configurations of both surfaces 12 and 22.

According to another illustrative embodiment, the robot arm 16 is equipped with sensor(s) and is so programmed as to precisely locate each new product 20 to pick and to determine a dropping position in accordance with the dynamic configuration of the stack 28.

The slip-sheet dispenser 26 is in the form of a generally rectangular rack, having a tilted bottom (not shown), and two adjacent side walls 30 extending upwardly from the bottom and defining mechanical stops for a pile of slip sheets 34 therein. The slip-sheets 34 are made, for example, of foam, plastic, paper, or wood.

The slip-sheet dispenser 26 is positioned adjacent palletizing surface 12.

According to another embodiment, another mechanism than the illustrated dispenser 26 is provided to dispense slip-sheets 34, such as a rack having a rising bottom. According to still another embodiment the slip-sheet dispenser is omitted. According to still another embodiment (not shown), the slip-sheets are replaced by other types of separators, such as wood veneer, foam and plastic mesh pieces or omitted.

Since slip-sheet dispensers are believed to be well-known in the art, they will not be described herein in more detail for concision purposes.

The adaptable spacer robot installation system 24 includes i) a robot arm 42 that is positioned adjacent the palletizing surface 12 so as to be within operational reach thereof and that is equipped with a tool head 44, and ii) a rope positioning system 46 that is positioned adjacent the palletizing surface 12 on a side thereof opposite the robot arm 42.

The robot arm 42 is in the form of conventional robot arms, such as, without limitation, a Fanuc™ robot from the F-400, N-710, N-900, or R-2000 series. The arm 42 is equipped with the tool head 44.

It is to be noted that the robot arm 42 can be of a smaller caliber than then robot arm 16, considering that the heaviest load it has to manipulate is a slip-sheet 34. As will also be described hereinbelow in more detail, the robot arm 42 is further equipped with a rope guiding mechanism 48.

With references to FIGS. 2 and 3, the tool head 44 will now be described in more detail.

The tool head 44 includes a frame assembly 50 having a length, a ropes inlet 52 secured to the frame assembly 50 for receiving and guiding independently therethrough a plurality of ropes 32 (two (2) according to the illustrative embodiment) from outside the robot tool 44, and guiding independently the rope 32 from outside the robot tool 44, a plurality of rope nozzles 54 (five (5) according to the illustrative embodiment) positioned along the length of the frame assembly 50, each one for guiding one of the plurality of ropes 32 out of the robot tool 44, rope guiding elements 56, mounted to the frame assembly 50, for independently guiding the plurality of ropes 32 between the rope inlet 52 and the plurality of rope nozzles 54, and for preventing the plurality of ropes 32 from intertwining between the rope inlet 52 and plurality of rope nozzles 54, and a rope cutter 58 secured to the frame assembly 50 and being so positioned thereon as to cut the plurality of ropes 32 exiting from the plurality of rope nozzles 54 as a result of a controlled pivot movement of the robot tool 44 when the ropes 32 are tight.

The frame assembly 50 is defined by two (2) generally U-shaped beams 60-62 that are assembled back-to-back on a plate 63 and defining upper and lower portions 64-66 of the frame assembly 50.

The longitudinal sides 68 of the upper U-shaped beam 60 include a plurality of mounting holes 70. The lower U-shaped beam 62 is closed on its bottom side 71, by two parallel perforated plates 72, defining a central slit 74 therebetween, that extends along the length of the frame assembly 60.

The frame assembly 50 further includes a mounting plate 76 that is secured to both U-shaped beams 60-62 and central plate 63 and which defines a proximate end of the frame assembly 50.

An elongated mounting bracket 77, provided with proximate and distal rounded sides 78 and 80, is provided to mount the frame assembly 50 to the tool-receiving end 82 of the robot arm 42 (see on FIG. 1).

On the side of the tool head 44, the bracket 77 is secured by its distal side 80 to the frame assembly 50 via the mounting plate 76 thereof using a pair of mounting disks 84 and fasteners 86. The bracket 77 is similarly attached to the robot arm 42.

The frame assembly 50 further includes reinforcing ends 88 and upper members 88 and 90.

The parts of the frame assembly 50 are assembled using, for example, welding and/or press-fitting of tongues and notches complementary elements. Brackets and fasteners can also be used.

The ropes inlet 52 comprises two side-by-side aligned pairs of proximate wide rope guides 92, secured to the distal side 80 of the upper beam 60 on the upper edge thereof, a ropes splitter 94, secured to the upper beam 60 at a short distance from the wide rope guides 92, and a rope-clamping device 95, secured to the upper beam 60, between the wide rope guides 92 and the small rope guides 94.

The wide rope guides 92 are in the form of rectangular shaped rings having a circular hole 93 therein, which is sufficiently wide to allow passage for more than one ropes 32 therethrough. Together the four wide rope guides 92 define two entrance channels for the ropes 32 entering the tool head 44.

The ropes splitter 94 is in the form of a rectangular plate having the same number of holes 98 therein than the number of nozzles 54 (five (5) according to the illustrative embodiment), which defines the maximum number of ropes 32 that can be simultaneously installed by the adaptable spacer robot system 24.

Each hole 98 has a diameter that is smaller than the holes 93, but sufficiently wide to allow unrestricted passage of a rope 32 therein.

The rope-clamping device 95 comprises i) an upper plate 96 that is pivotably mounted to both longitudinal sides 68 of the upper beam 60 therebetween via two side brackets 100, ii) an actuator 97 for pivoting the upper plate 96 between open and closed positions, the closed position corresponding to the upper plate 96 being parallel to the upper edge of the upper beam 60, and iii) a lower plate 99 that is secured to the distal side 80 of the upper beam 60 on the upper edge thereof so as to be registered with the upper plate 96 when it is in its closed position.

Both side brackets 100 are secured to the side 68 using registered holes 70 and fasteners 101.

The rope-clamping device 95 is activated to squeeze unto the ropes 32, for example when the tool 44 finishes pulling thereon, to prevent excess unwinding, and to maintain a desired length thereof.

According to a more specific embodiment, at least one of the upper and lower plates 96 and 99 is made of a friction-promoting material, such as urethane, rubber, etc.

The rope inlet 52 is not limited to the illustrative embodiment and may take any form allowing first guiding the ropes 32 entering from outside the tool head 44. For example, the rope inlet 52 can be configured for a maximum number of ropes 32 that is more or less than five. Also, the inlet 52 is not limited to provide more to less restrictive channels for the rope 32.

Each of the plurality of rope nozzles 54 includes a small tube 102 that is provided to allow passage of a single rope 32 therein and to orient its exit from the tool 44. According to the illustrated embodiment, the tubes 102 are aligned along the length of the frame assembly 50 and oriented downwardly.

Figure 2:
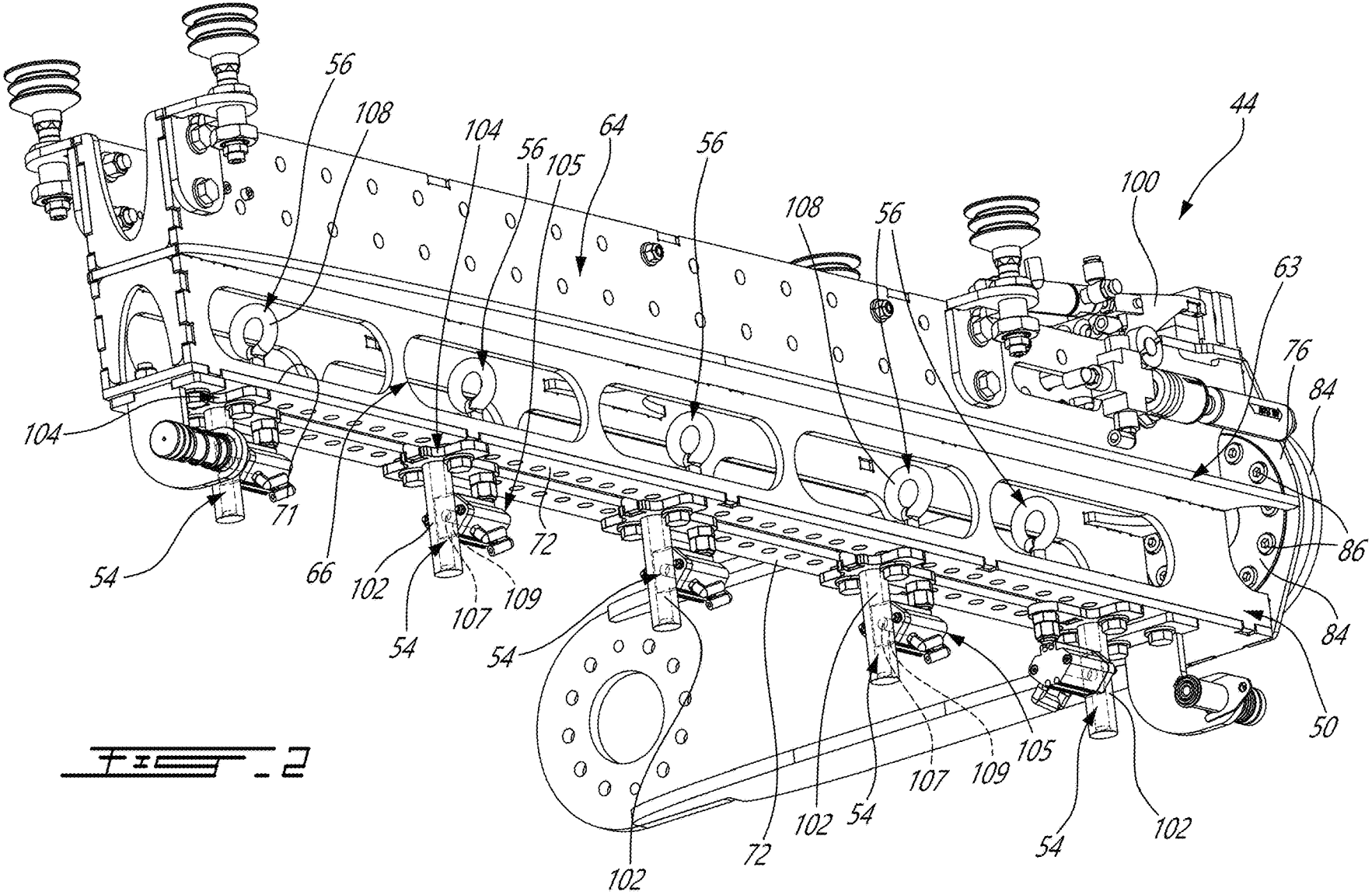
FIGS. 2 and 3 are respectively upward and downward perspective views of an adaptable robot tool for installing spacer robot between palletized products according to a first illustrative embodiment.
Figure 3:
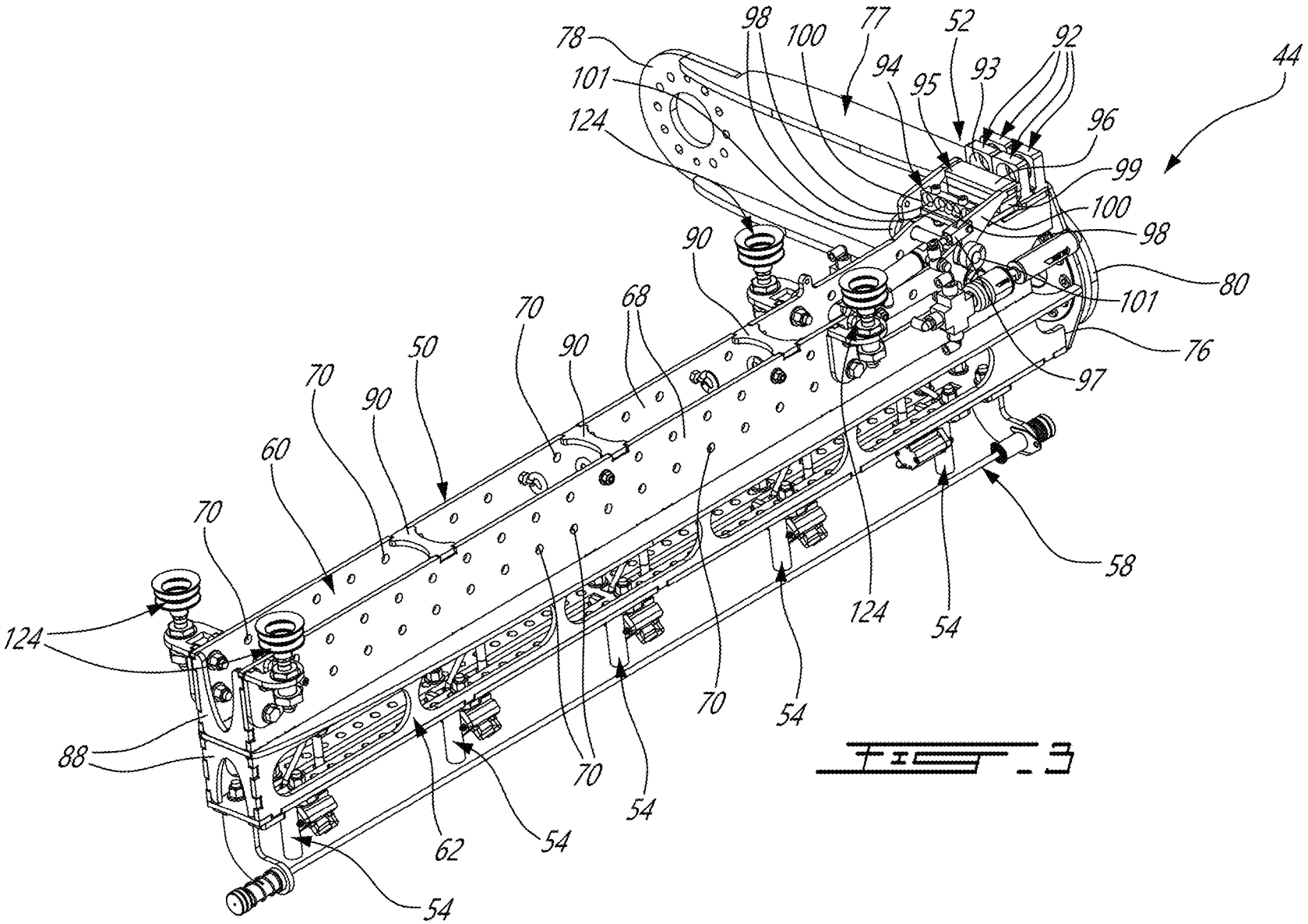

As can be better seen in FIG. 2, each tubes 102 is secured to the two parallel perforated plates 72 via a T-shaped bracket 104. The T-shaped brackets 104 are attached to the plates 72 using fasteners in the holes of the plates 72. As such, the position of the nozzle cylinders can be modified easily, for example according to the geometry of the products 20 or to the palletizing pattern.

Each T-shaped bracket 104 includes a central spout 106 to attach a tube 102 thereto and that is registered with the central slit 74 when the bracket 104 is secured to the frame assembly 50 thereunder. Each of the ropes 32 passes from the inlet 52, through the slit 74 and then through a respective one the nozzles 54.

Each nozzle 54 further includes a rope immobilizer 105 to prevent the recoil in the tube 102 of the end of the rope 32 when the tool 44 makes certain movements, such as moving upside down. More specifically, the rope immobilizer 105 is in the form of a mini cylinder, whose plunger 107 is movable within the tube 102 through a small hole 109 therein, to pinch onto the rope 32 to prevent recoil thereof within the tube 102. The mini cylinder 105 is attached to the bracket 104 so as to be operatively positioned relative to the tube 102.

The nozzles 54 are not limited to the illustrative embodiment. For example, the tube 102 can be made of different length or diameter than illustrated or thy can be omitted. The nozzles 54 can also be made mountable differently to the frame assembly 50. According to still another illustrative embodiment, they can be fixedly mounted to the frame assembly at same or different positions than illustrated.

The rope immobilizer 105 is not limited to the illustrated embodiment. According to another illustrative embodiment (not shown), the immobilizer is in the form of a flexible tongue mounted within the tube 102 that is so oriented as to allow passage to the rope 32 towards the exit but to prevent recoil. According to still another embodiment, the immobilizer 105 is omitted.

Each of the rope guiding elements 56 are in the form of eye bolts that are secured to the plates 72 therebetween via a respective T-shaped bracket 104. More specifically, the eye bolts 56 act as third fasteners therefor. According to such an arrangement, each the eye bolts 56 is in close proximity to a respective nozzle 54, allowing to smooth the change of direction of a rope from the rope inlet 52 to the nozzle 54. As such, the height of the eye portion 108 can further be adjusted.

From the above, a person skilled in the art will now appreciate that the ropes 32 that enter the tool head 44, exit the tool head in an ordinate fashion. According to the illustrative embodiment, one (1) to five (5) ropes may pass freely through the tool head 44 and exit therefrom in an aligned parallel relationship and along a same direction, the tool head 44 further acting as an orientation guide by its controlled movements as inferred by the robot arm 42.

According to another illustrative embodiment, the rope guiding elements take another form than illustrated or are omitted.

Returning briefly to FIG. 1, the ropes 32 are incoming from a reel system 110, which includes at least the number of reels 112 of ropes 32 required for a given application (two (2) according to the illustrative embodiment). The reels 112 are rotatably mounted to a rack 114 provided with a shelf 116 on the top 118 thereof.

The reels 112 of ropes 32 are mounted on the output shaft of a rotary actuator (not shown), which can be actuated to create tension onto the ropes 32 when a portion thereof downstream from the reel 112 is prevented from moving, for example by being under one of the products 20. The rotary actuator can also be operated to that the output is free to move.

Since rotary actuators are believed to be well-known in the art, they will not be described herein in more detail.

According to another illustrative embodiment, the reels 112 are mounted to a shaft for free rotation and a further rope blocking system is provided downstream of the reels 112, such as for example a mechanical clamp (not shown).

A set of parallel pulleys 120 is provided on the shelf 116, which further includes openings (not shown) that allow passage for the ropes 32 from the reels 112, each rope 32 being then operatively mounted to one of the pulleys 120. According to the illustrative embodiment, the number of pulleys 120 is the same as the number of support (not shown) for the reels 112, which is also the same as the number of nozzles 54 on the tool head 44.

According to another illustrative embodiment, the number of pulleys 120 and/or reels 112 is different than the number of nozzles 54 on the tool head 44, but sufficient for the number of ropes 32 required for the application.

As indicated hereinabove, the robot arm 42 is provided with rope guiding system 48 mounted thereto, to support and guide the ropes 32 between the reel system 110 and the tool head 44. The guiding system 48 may include a set of parallel pulleys 120 and an adjustable inclined plate 122 adjacent the set of pulleys 120. From the rope guiding system 48, the ropes 32 continue through the tool head 44 as indicated hereinabove.

According to another embodiment (not shown), another rope feeding system than the illustrated reel system 110 is provided.

Also, according to another illustrative embodiment, the rope guiding system on the robot arm 42 are different or differently positioned on the arm 42 than illustrated or omitted.

Returning to FIGS. 2 and 3, the rope cutter 58 is in the form of well-known hot wire cutter, that is mounted to the frame assembly 50 thereunder and so as to extend substantially along its length. More specifically, the hot wire cutter extends along the plurality of nozzles 54 generally parallel to an axis defined by the aligned nozzles 54.

In operation of the rope cutter 58, the ropes 32 that exit the nozzles 54 are simultaneously cut by the hot wire cutter 58 when the ropes 32 are prevented from moving at one end by products 20 and at the other end by the reel system 110 and the tool head 44 is so pivoted as to put the ropes 32 along the path of the hot wire cutter 58.

Finally, the tool head 44 further comprises pneumatic suction cups 124 that are mounted to the upper portion 60 of the frame assembly 50 so as to extend upwardly. The suction cups 124 allow further using the tool head 44 for picking a slip-sheet 34 in the slip-sheet dispenser 26 and to lay the slip-sheet 34 on the palletizing surface 12 or between layers of products 20.

According to other illustrative embodiments, the number and/or configuration of the suction cups 124 are different than illustrated. According to still another illustrative embodiment, the suctions are replaced by another sheet-picking mechanism mounted to the tool head 44 or independent therefrom. According to yet another illustrative embodiment, no such sheet-picking mechanism are provided.

Figure 4:
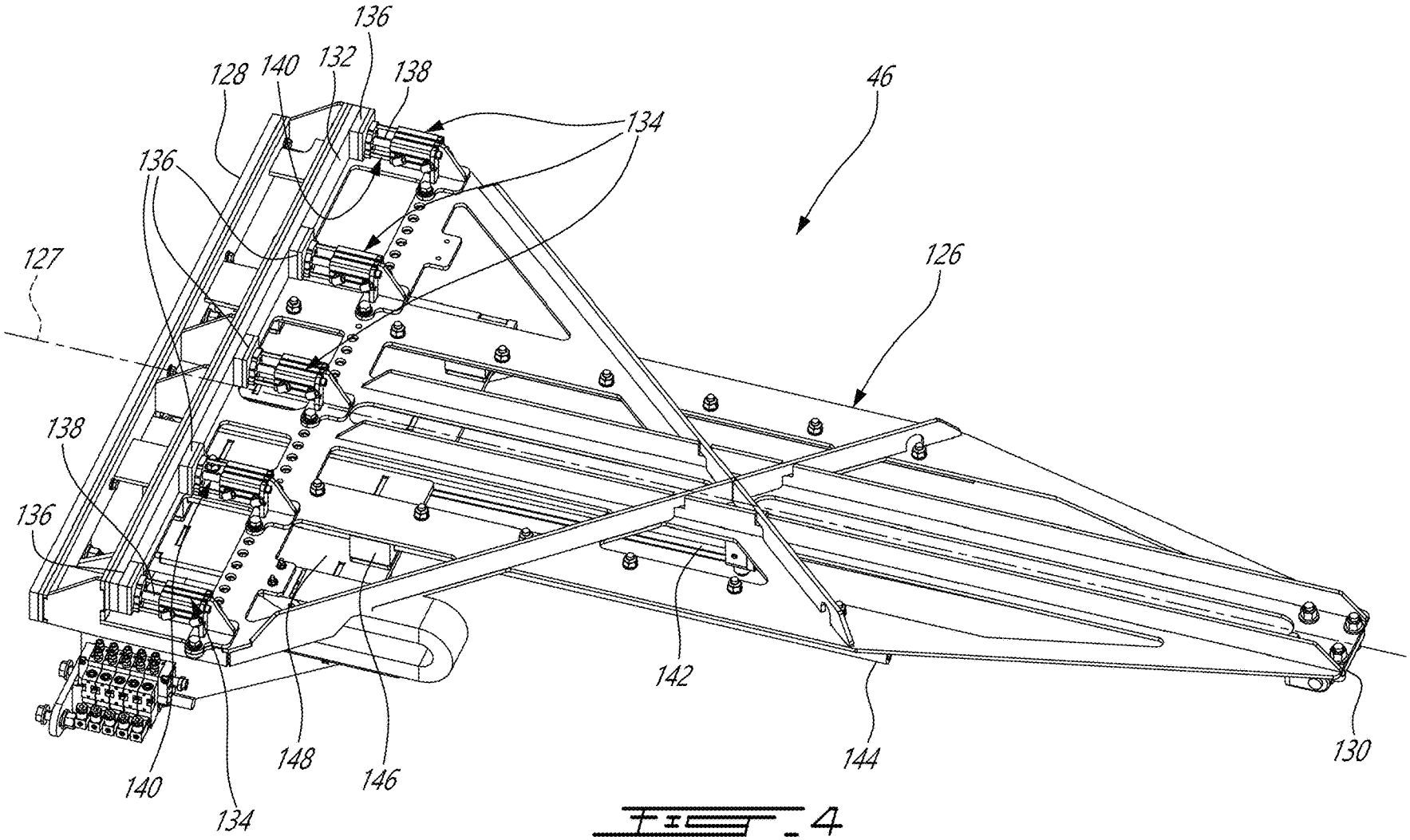
FIG. 4 is perspective view of a rope positioning system according to a first illustrative embodiment, the rope positioning system being part of the palletizing system from FIG. 1.

Turning now to FIG. 4, the rope positioning system 46 will now be described in more detail.

The rope positioning system 46 comprises a mounting frame 126 defining a longitudinal axis 127 and having proximate and distal ends 128-130 therealong, a rope-positioning bar 132 mounted to the mounting frame 126 near the proximate end 128, a plurality of linear actuators 134, each having a pad 136 mounted at the end of its rod 138, and being operatively mounted on the frame 126 in close proximity to the rope-positioning bar 132 so as to define a gripper 140 therewith.

As can be seen in FIG. 1, the mounting frame 126 is slidably mounted to the conveyor 36 via a linear actuator 142 and sliding members 144-146 so as to be adjacent to the conveying surface 12 and levelled therewith on a side thereof opposite the robot arm 42. The frame 126 is movable on the palletizing surface 12 towards and away the robot arm 42.

More specifically the rope positioning system 46 comprises a mounting support 148 that is fixedly mounted to conveyor 36 using fastening or attaching means (not shown).

First sliding members 144 are in the form of a pair of rods fixedly mounted to the mounting frame 126 thereunder so as to extend parallel to the axis 127. Second sliding members 146 are in the form of rod guides that are secured to the mounting support 148. The first and second sliding members are assembled to allow the mounting frame 126 to slide freely along the axis 127 relative to the mounting support 148, and therefore also relative to the conveying surface 12.

The linear actuator 142 is operatively mounted to both the mounting frame 126 and support 148 therebetween and is operable to controllably move the mounting frame 126 relative to the mounting support 148 towards and away the robot arm 42.

The rope-positioning bar 132 is fixedly mounted to the mounting frame 126 near the proximate end 128 end thereof so as to be oriented perpendicularly to the axis 127.

Figure 7:
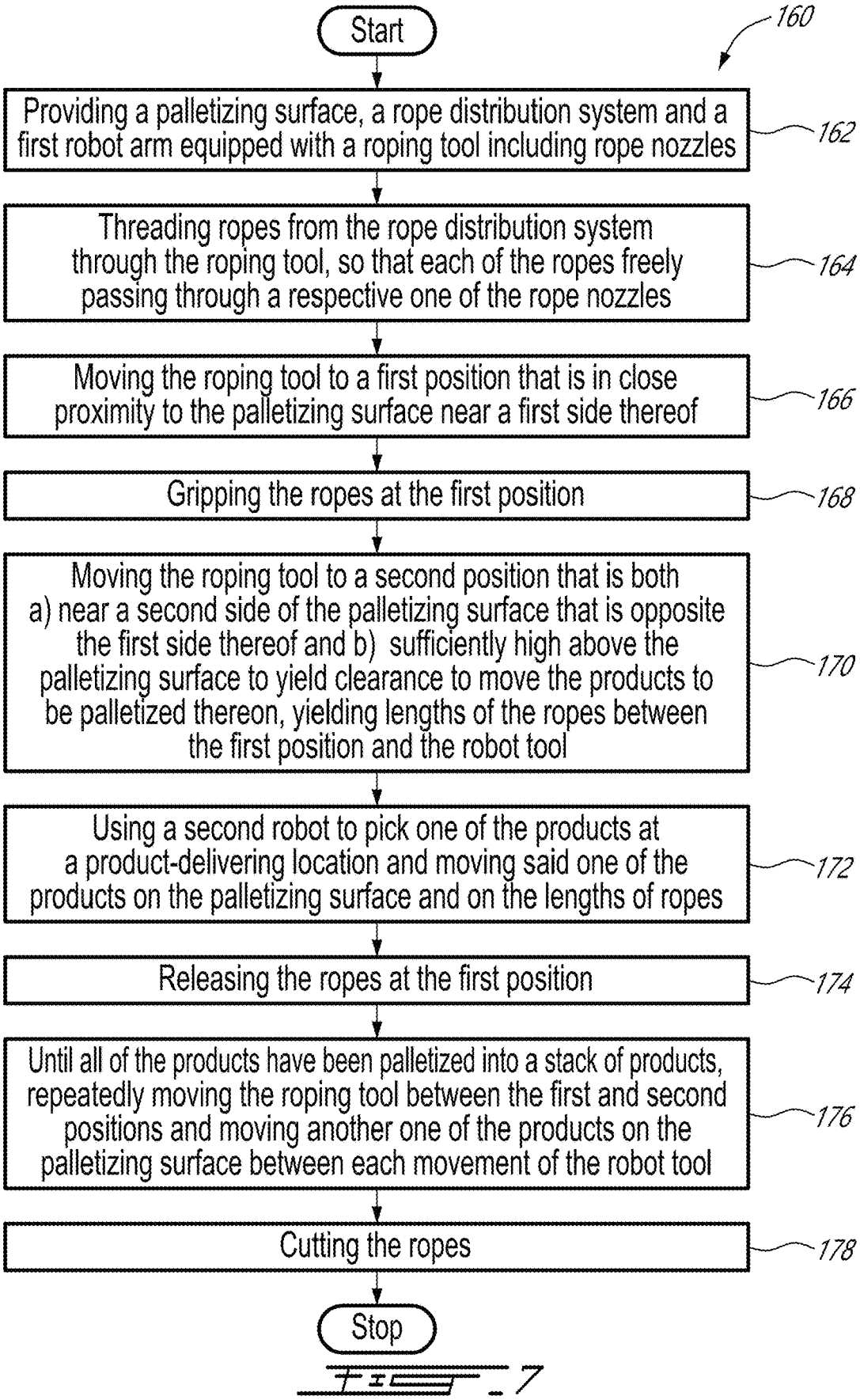
FIG. 7 is a flowchart of palletizing method according to an illustrative embodiment.

The operation of the rope positioning system 46 and further characteristics will become more apparent upon reading the following description of the operation of the palletizing system 10 with references to FIGS. 5A-5G and with references to a palletizing method as shown in FIG. 7.

Prior to be used in a new palletizing application, the adaptable spacer robot system 24 is prepared as follows: a number of reels 112 of ropes 32 corresponding to the number of ropes 32 required for the given application (two according to the illustrative application) is installed in the reel system 110 and the ropes 32 are threaded through pulleys 120 on the shelf 116 of the reel system 110, then through the rope guiding mechanism 48 on the robot arm 42, and finally through the robot tool 44 as described hereinabove so that the ropes 32 partially exit the nozzles 54 (step 164 in FIG. 6).

Regarding the above-described preparation of the system 24, it is interesting to note that no changes are required to the system 24 if the required number of ropes 32 is between one (1) and five (5).

Also, the system 24 can be used without modifications with ropes 32 of different caliber and material, if they are threadable through the system 24.

Finally, the positions of the ropes 32 along the length of the tool head 44 can be easily modified by selecting the specific nozzles 54 and by modifying the position thereof along the frame assembly 50.

As part of the palletizing process, a slip-sheet 34 is picked first by moving the tool head 44 above the dispenser 26 and by orienting the tool head 44 so that the vacuum cups 124 are oriented towards the slip-sheet 34 on the top of the dispenser 26. The vacuum cups are then actuated to grip a slip-sheet 34 from the top of the pile.

While the tool head 44 with the slip sheet 34 is still above the dispenser 26, the robot arm 42 is controlled to move the tool head 44 up and down rapidly with jerky movements (not shown). Such movements have been found to allow the fall of any additional slip-sheet 34 that could have been taken by error due to static electricity, along with the one on top of the pile. According to another illustrative embodiment, depending for example on the material of the slip-sheet 34, such movements of the tool head 44 are omitted.

The tool head 44 is then moved towards the palletizing surface 12, where the slip-sheet 34 is deposited by stopping the vacuum action of the vacuum cups 124. In some applications, where slip-sheets 34 are not required, this step is omitted.

Figure 5A:
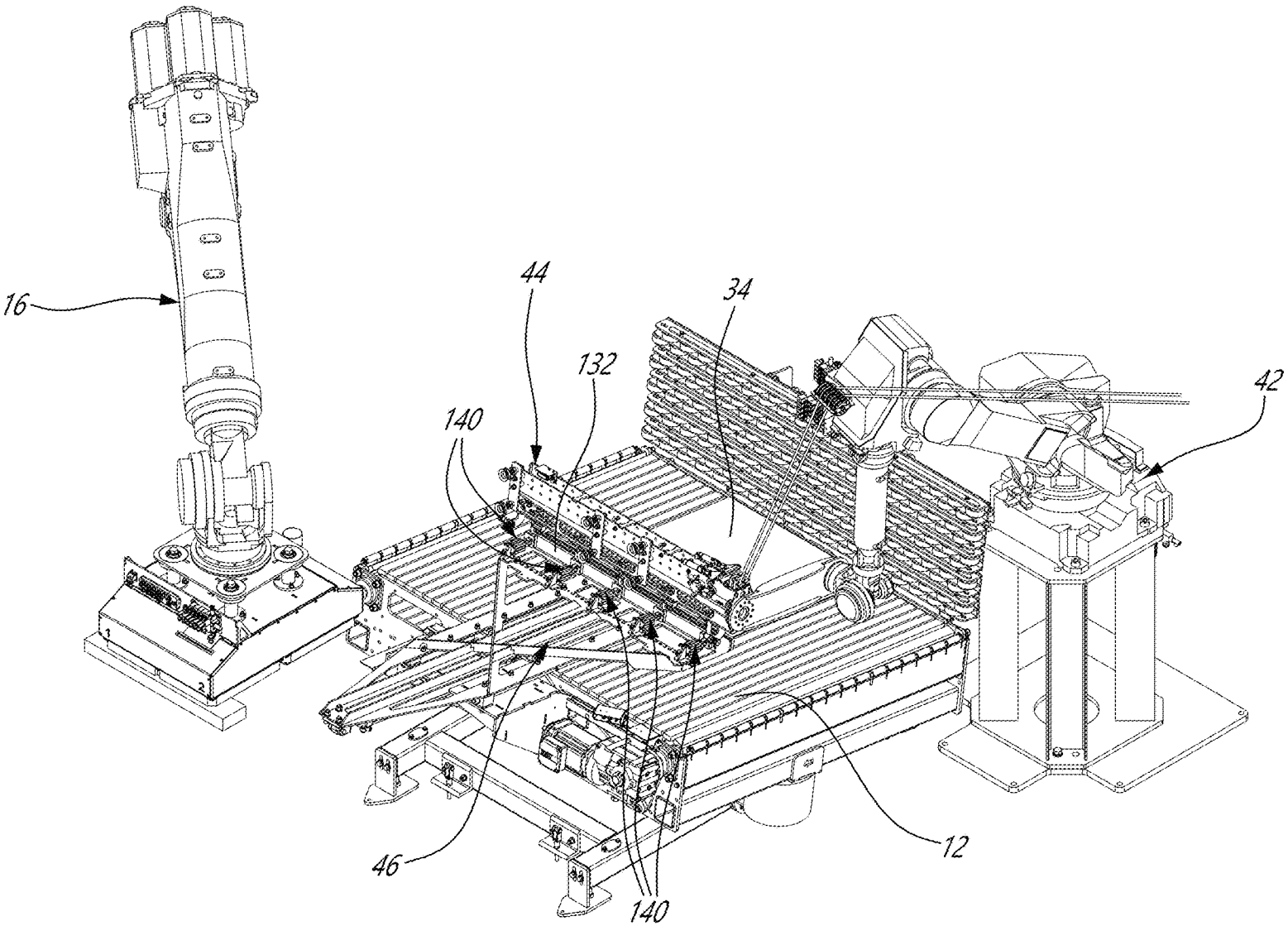
FIGS. 5A-5G are perspective views of the adaptable spacer robot installation system part of the palletizing system from FIG. 1, illustrating the operation thereof.

With reference to FIG. 5A, the rope positioning system 46 and more specifically its linear actuator 142 is then operated to move the rope-positioning bar 132 towards the frictionless wall 38 until the bar 132 is adjacent the slip-sheet 34 on the palletizing surface 12 (step 166).

The tool head 44 is then both pivoted and translated by the robot arm 42 to position the nozzles 54, with the short lengths of ropes 32 extending therefrom, between the rope-positioning bar 132 and the pads 136 of the grippers 140. The grippers are then actuated to grip onto ends of ropes 32 (step 168).

Figure 5B:
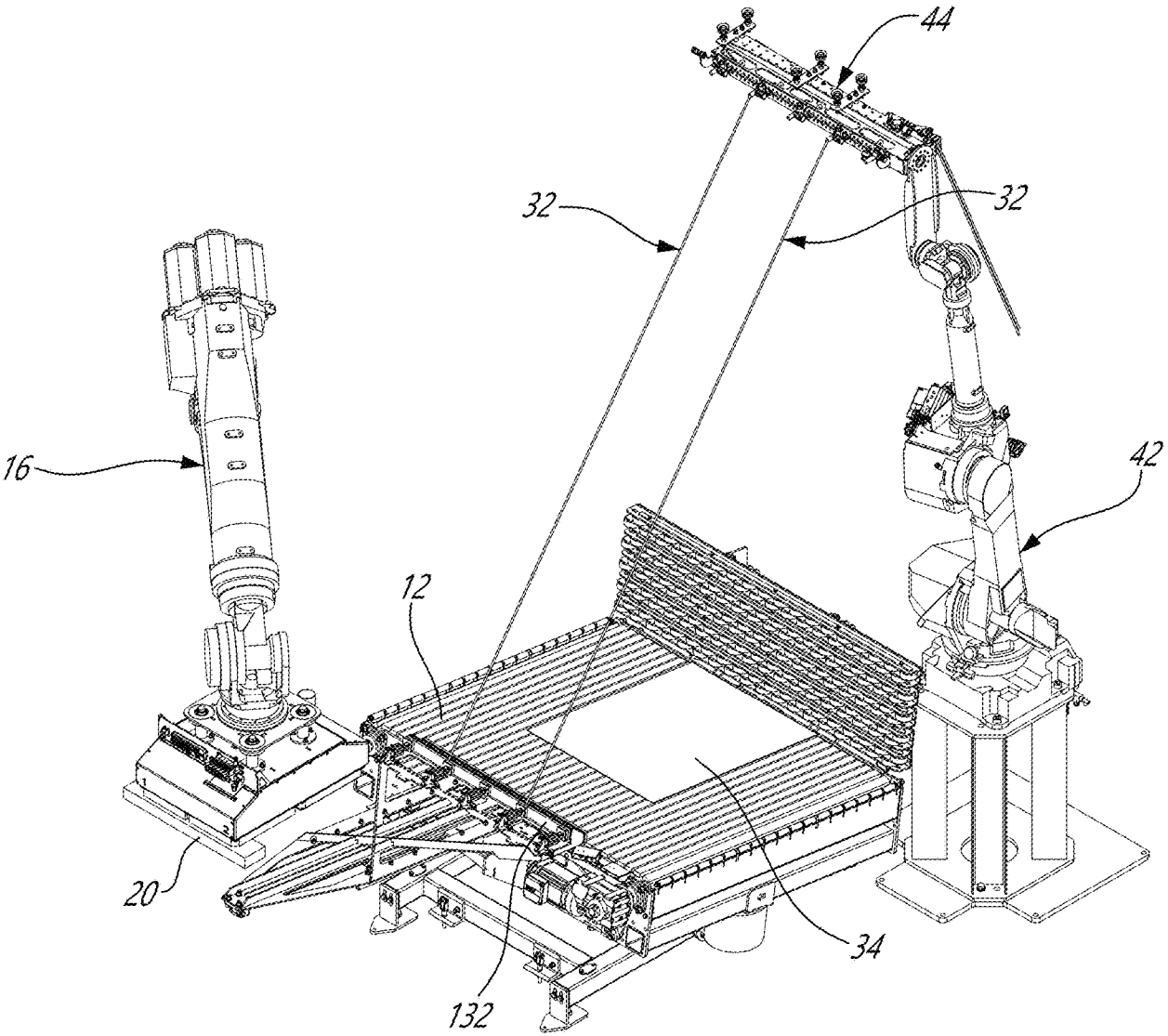

With reference to FIG. 5B, the rope positioning system 46 is then operated to move the rope-positioning bar 132 back to its original position, along the edge of the palletizing surface 12.

According to another illustrative embodiment (not shown), the bar 132 remains near the edge of the palletizing surface 12, where the tool head 44 is moved for the ropes 32 to be gripped.

While the ends of the ropes 32 are still gripped by the grippers 140, the tool head 44 is moved back by the robot arm 42 so as to be distanced from the bar 132, parallel thereto, and above the palletizing surface 12 (step 170). At such a position, the robot arm 42 clears the way for the palletizing robot 16 to move a product 20 on the palletizing surface 12 while the ropes 32 remain above the palletizing surface 12. These are the two main criteria to determine the location of this fallback position of the robot arm 44, which is not limited to the illustrative embodiment.

As can be further seen from FIG. 5B, during the above-described steps executed by the rope positioning system 46, the palletizing robot arm 16 have been controlled to pick one of the products 20 on the product-delivering surface 22, which it is ready to be positioned on the palletizing surface 12.

Figure 5C:
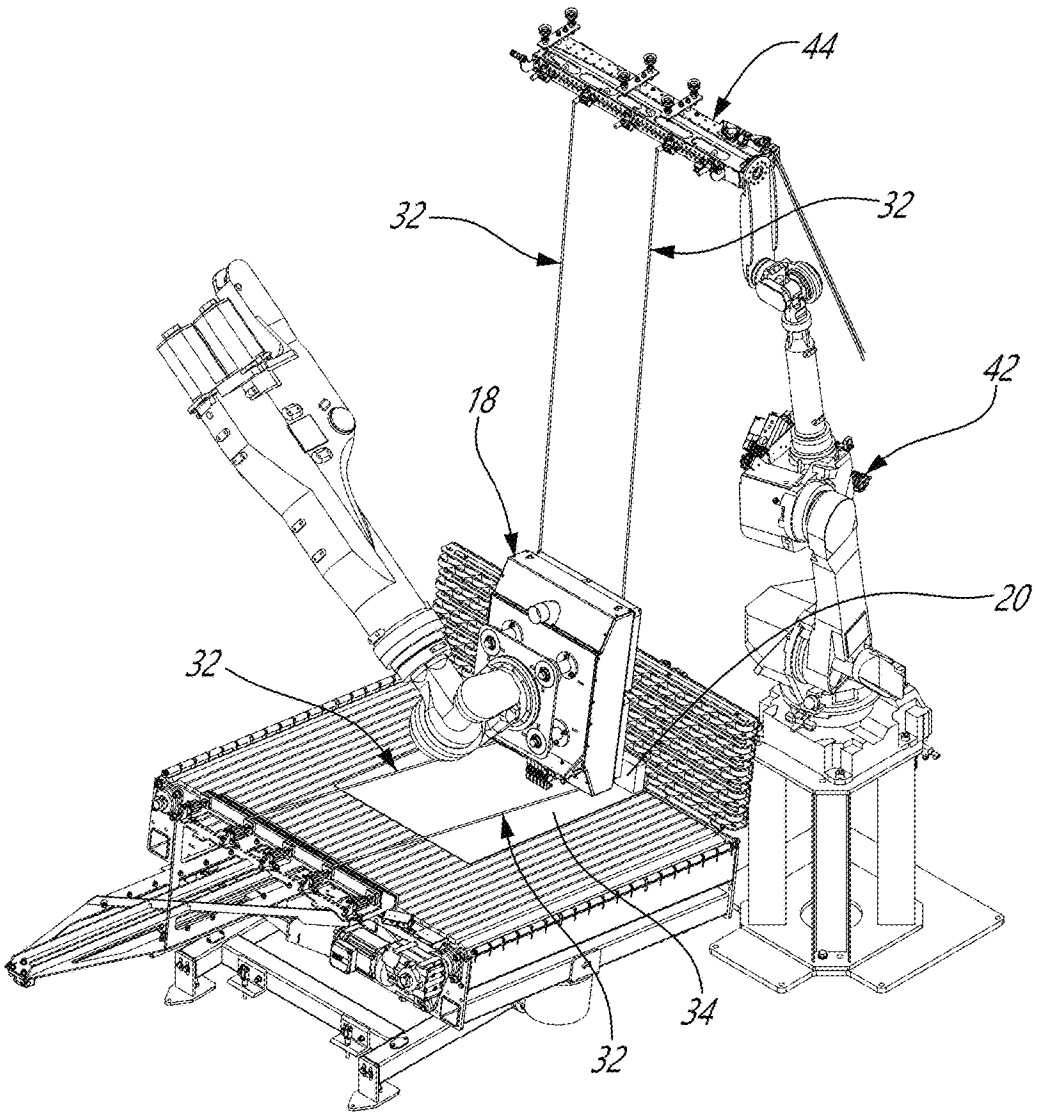

With references to FIG. 5C, the robot 16 is controlled to position the picked product 20 on the palletizing surface 12 (step 172). More specifically, the robot 16 is coupled to a controller (not shown), which is programmed with a palletizing sequence elaborated considering the geometry of the products 20 and a desired palletizing pattern. According to another illustrative embodiment, the robot or controller is equipped or coupled to an artificial vision system (not shown) and/or the controller is programmed with an algorithm or include an artificial intelligence engine to place each product within predetermined parameters.

According to the illustrative embodiment, the product 20 is positioned on the slip-sheet 34, abutted to the friction-less wall 38. In doing so, the product 20 is positioned onto the two (2) ropes 32. During that step, the reel system 110 is operated so that the reels 112 are free to rotate, while the grippers 140 continue to get hold on the ropes 32, forcing the reels to unwind.

Figure 5D:
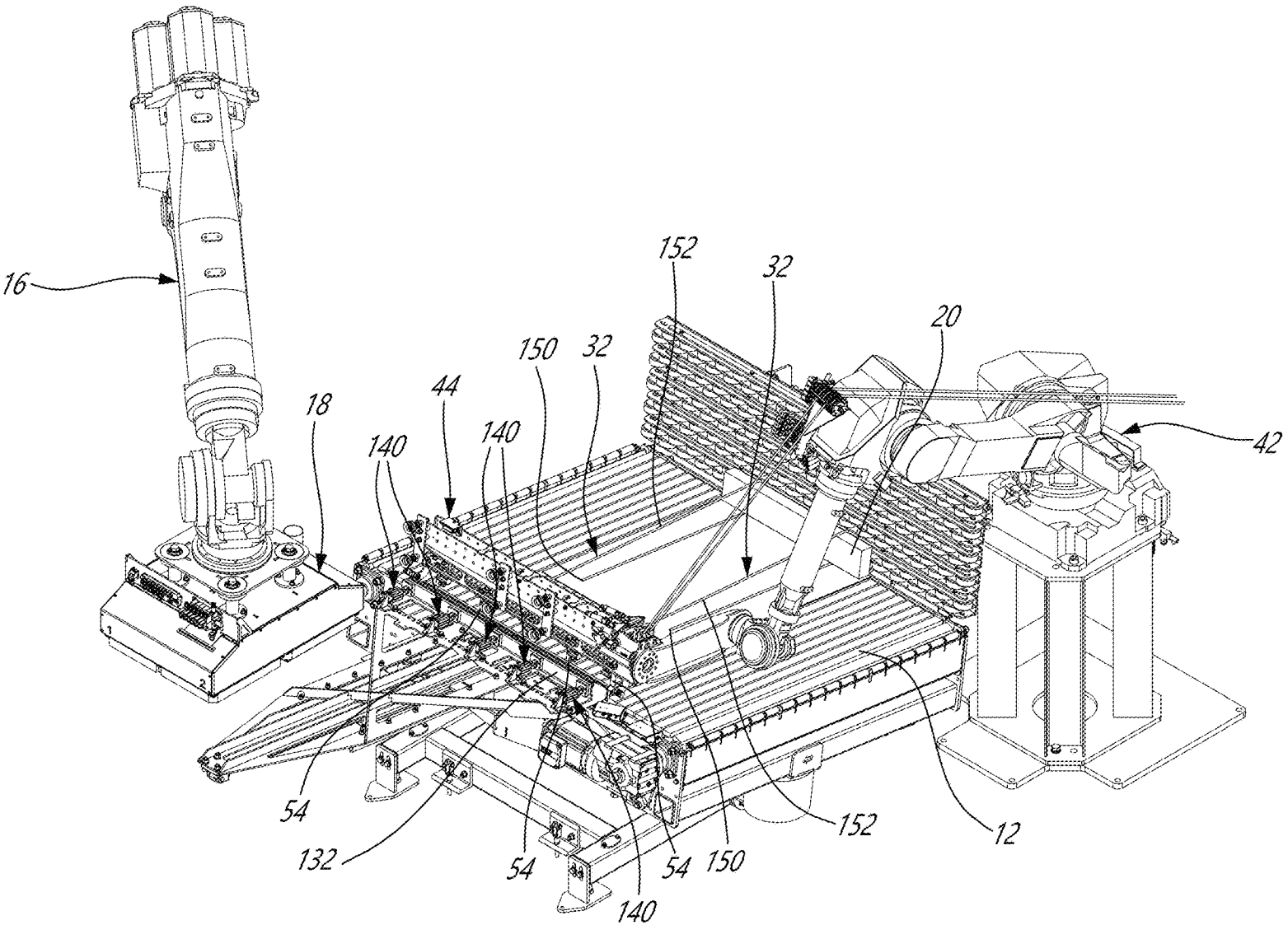

With reference to FIG. 5D, the palletizing robot 16 is controlled so that the vacuum gripper 18 release its grip on the products 20 and then returns to the product-delivering surface 22. Considering that both ropes 32 are held in position under the products 20 on the palletizing surface 12, the grippers 140 can then release their hold on the free ends 150 of the ropes 32 (step 174).

The tool head 44 is moved by the robot arm 42 to a rope-positioning position, where the nozzles 54 are in close proximity with the rope-positioning bar 132, and each nozzle 54 registered with a corresponding gripper 140. In such a position of the tool head 44, the portions 152 of the ropes 32 between the products 32 and the tool head 44 are ensured to pass both over the products 20 and between the product 20 and the next product 20 to be positioned.

Figure 5E:
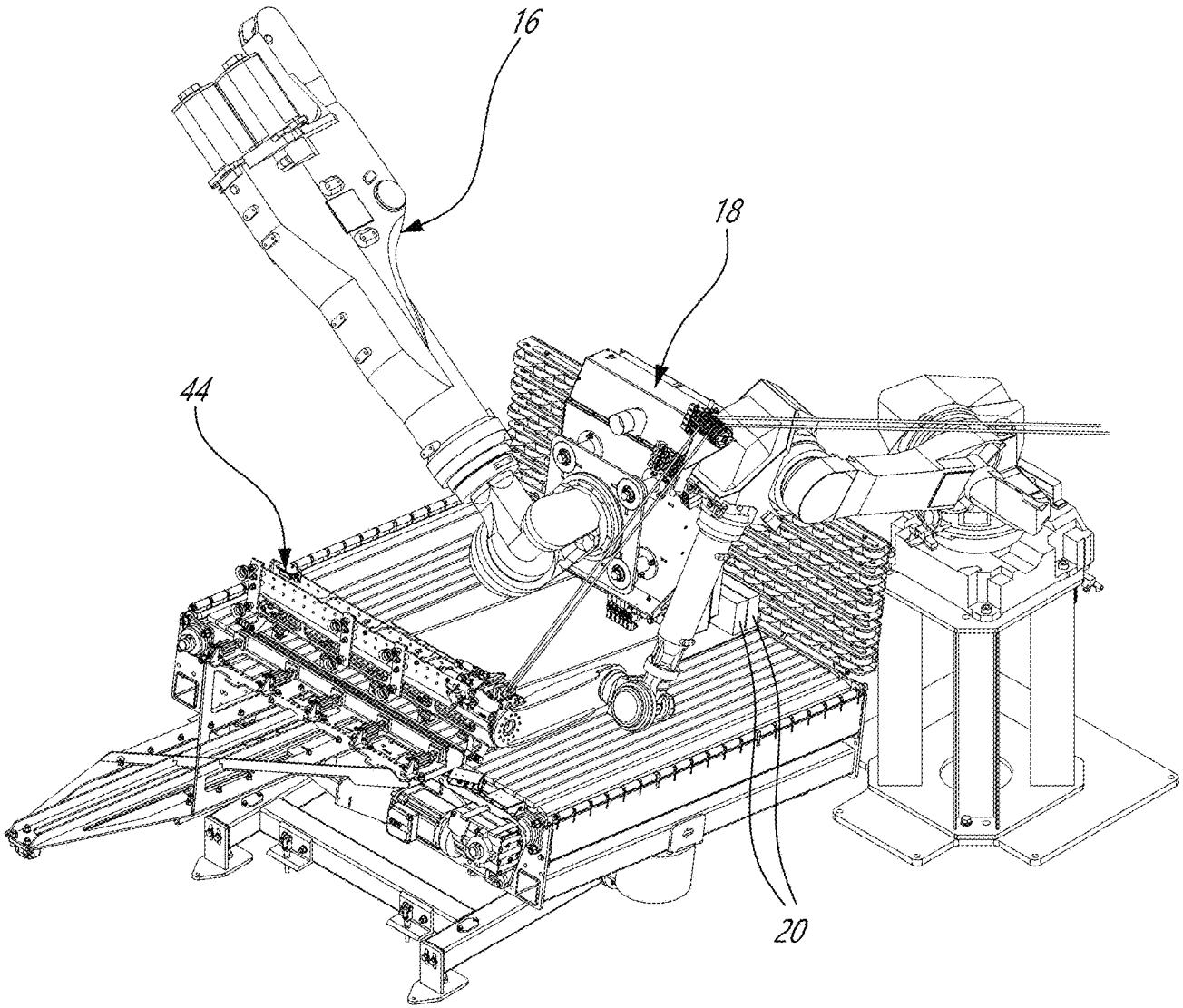
Figure 5F:
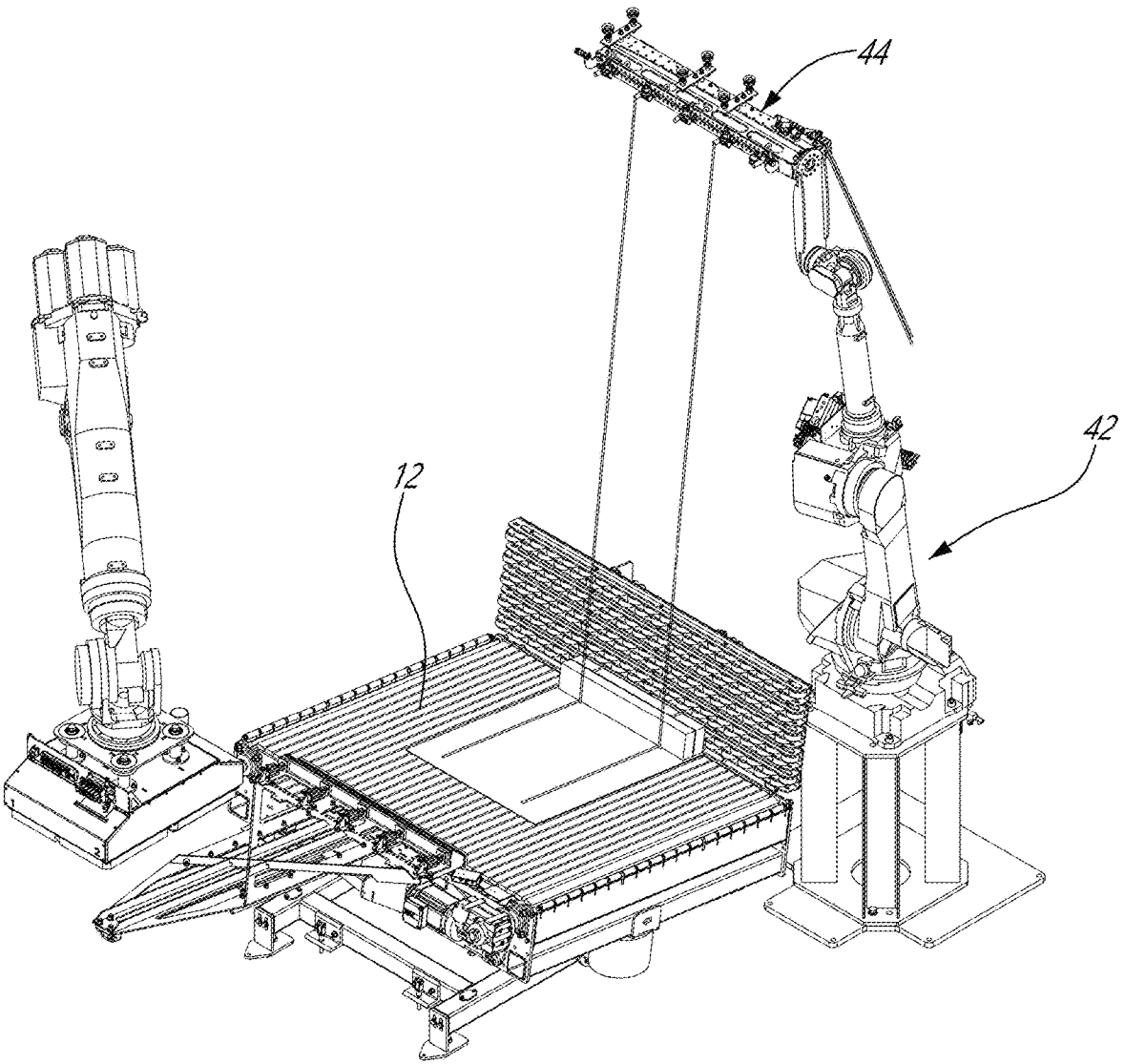

While the tool head 44 is this rope positioning position, the palletizing robot 16 is controlled to move a new product 20 on the palletizing surface 12 (see FIG. 5E). The tool head 44 is then moved to its fallback position as described hereinabove, as a new palletizing cycle begins (see FIG. 5F).

Figure 5G:
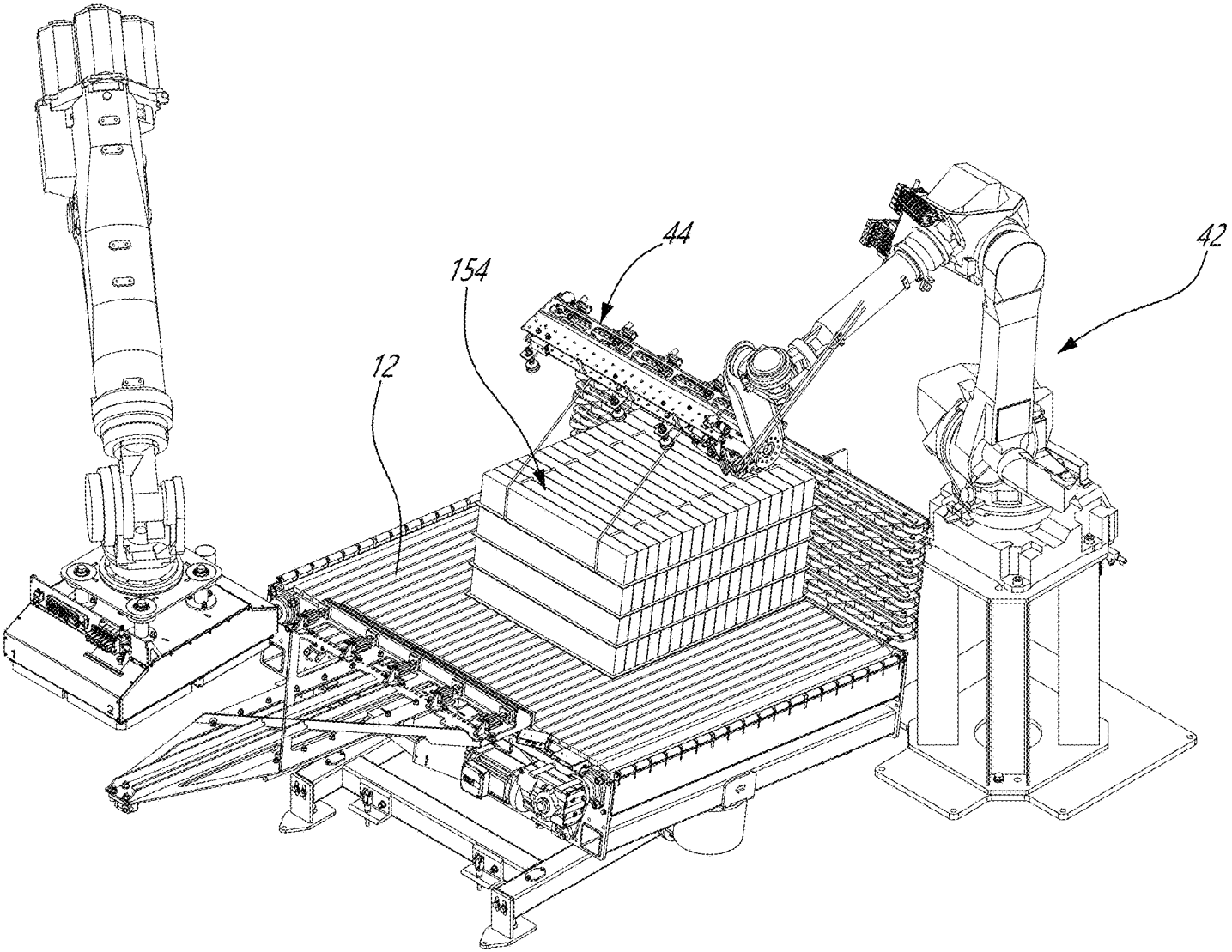

Once the formation of a pallet or stack of products 20 is achieved, the ropes 32 are cut (step 178). This is illustrated in FIG. 5G. This step is achieved by the tool head 44 pivoting so as to put the ropes 32 with the path of the rope cutter 58, while tension is kept on the ropes 32 by the reel system 110.

The thus formed pallet 154 is then moved away from the palletizing surface 12 by actuating the conveyor 36.

Figure 6:
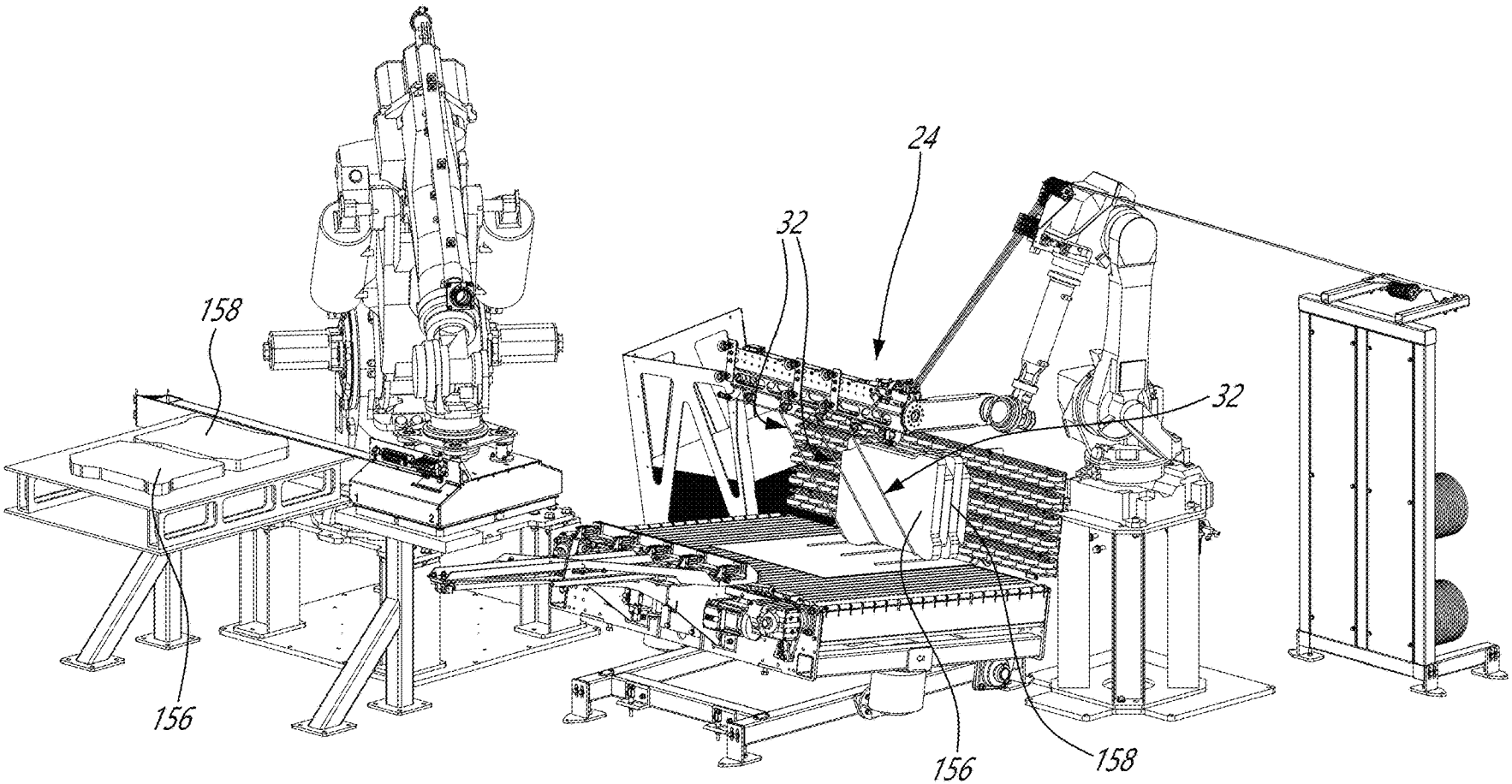
FIG. 6 is a perspective view of the system from FIG. 1, adapted for products having another geometry, illustrating the adaptability of the spacer robot system from FIGS. 5A-5G.

As illustrated in FIG. 6, and as described hereinabove, the adaptable spacer robot installation system 24 can be easily adapted for products of different geometry, such as, without limitations, concrete patio slabs 156 and 158, and for different number of ropes (three (3) shown in FIG. 6).

The operation of both robots 16 and 42 of the reel system 110 and of the rope positioning system 46 are controlled by one or more controllers. Since such controllers are believed to be well-known in the art and since the programming thereof are believed to be within the reach of a person skilled in the art, they will not be described further in in more detail for concision purposes.

It is to be noted that connectors, cables, and other secondary or non-mechanical components of the system 10 have been omitted in the figures so as to alleviate the views.

It is to be noted that many modifications could be made to the palletizing system 10 described hereinabove, for example:

- the rope positioning system 46 can be replaced by another mechanism, device or system allowing to get hold on the ropes and or allowing an adequate operational positioning of the ropes 32 during the positioning of products 32 on the palletizing surface 12;
- another mechanism, device or system than the reel system 110 can be used to provide ropes to the system 46;
- while the system 10 is described with reference to casted concrete products, it can be used with other types of products.

Although an adaptable spacer robot installation system for casted concrete products or the likes and a palletizing system therewith have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A method for palletizing a plurality of products, the method comprising:

providing a palletizing surface;

providing a rope distribution system;

providing a first robot arm equipped with a robot tool including rope nozzles;

threading ropes from the rope distribution system through the robot tool, so that each of the ropes freely passing through a respective one of the rope nozzles;

moving the robot tool to a first position that is in close proximity to the palletizing surface near a first side thereof;

gripping the ropes at the first position;

moving the robot tool to a second position that is both a) near a second side of the palletizing surface that is opposite the first side thereof and b) sufficiently high above the palletizing surface to yield clearance to move the products to be palletized thereon, yielding lengths of the ropes between the first position and the robot tool;

using a second robot to pick one of the products at a product-delivering location and moving said one of the products on the palletizing surface and on the lengths of ropes;

releasing the ropes at the first position;

until all of the products have been palletized into a stack of products, repeatedly moving the robot tool between the first and second positions and moving another one of the products on the palletizing surface between each movement of the robot tool; and cutting the ropes.

2. The method of claim 1, further comprising a) determining whether a current layer of the products on the palletizing surface is finished before said moving another one of the products on the palletizing surface, and if the current layer is finished then: b) positioning a slip-sheet on the layer before commencing a new layer of the products, and c) determining the new layer as the current layer.

3. The method of claim 2, wherein said positioning a slip-sheet on the layer before commencing a new layer of the products is performed by the second robot.

4. The method of claim 3, wherein the slip-sheet is picked by the second robot on a slip-sheet dispenser.

5. The method of claim 4, wherein the second robot is equipped with a vacuum gripper.

6. The method of claim 2, wherein said positioning a slip-sheet on the layer before commencing a new layer of the products is performed by a slip-sheet picking mechanism.

7. The method of claim 6, wherein the slip-sheet picking mechanism includes at least one suction cup.

8. The method of claim 1, wherein the palletizing surface is defined by a conveyor.

9. The method of claim 1, wherein the palletizing surface is slanted and includes a mechanical stop on a lower side thereof.

* * * * *